US005106670A

United States Patent [19]

Wyslotsky et al.

[11] Patent Number: 5,106,670

[45] Date of Patent: Apr. 21, 1992

[54] METALIZED PACKAGE COMPONENTS AND METHODS OF FORMING THE SAME

[75] Inventors: Ihor Wyslotsky, Rolling Meadows, Ill.; Frank C. Mello, Zeeland, Mich.

[73] Assignee: Bil Mar Foods, Inc., Zeeland, Mich.

[21] Appl. No.: 465,487

[22] Filed: Jan. 16, 1990

Related U.S. Application Data

[63] Continuation-in-part of Ser. No. 239,517, Sep. 1, 1988.

[51] Int. Cl.[5] ..... B32B 9/00

[52] U.S. Cl. ..... 428/195; 428/220; 428/204; 428/206; 428/457; 428/461; 428/480; 428/516; 428/332; 229/123.2; 220/359

[58] Field of Search ..... 229/123.2; 220/359; 428/195, 220, 457, 461, 480, 204, 206, 516, 332

[56] References Cited

U.S. PATENT DOCUMENTS 4,209,126 6/1980 Elias ..... 220/359

*Primary Examiner*—Patrick J. Ryan

*Attorney, Agent, or Firm*—Allegretti & Witcoff, Ltd.

[57] ABSTRACT

The improved metallized package component of the present invention includes a thermoplastic, polymeric film laminate being formed from at least two, and possibly several, thermoplastic film layers. The thermoplastic film layers are selected to have substantially equivalent indices of refraction to minimize diffusion of light at the interfaces thereof to maintain substantial clarity and transparency of the film laminate. A metallic layer is disposed on at least one exterior surface of the film laminate, and accordingly is visible through the film from the opposite side thereof to provide a metallic appearance to both sides of the film laminate.

9 Claims, 2 Drawing Sheets

METALIZED PACKAGE COMPONENTS AND METHODS OF FORMING THE SAME

This application is a continuation-in-part of Ser. No. 239,517 filed on Sept. 1, 1988. The present invention is directed in general to the vacuum packaging machine and more particularly to an improved metalized package components and methods of forming the same.

BACKGROUND OF THE INVENTION

This is a continuation-in-part of application Ser. No. 239,517, filed on Sept. 1, 1988.

The present invention relates in general to packaging components and methods, and more particularly to an improved metallized package component and methods for forming the same.

In the prior art, various methods have been proposed for techniques of providing heat to thermoplastic polymeric film materials for forming packaging components, whether by various vacuum techniques, and with or without plug assist. Some of these techniques are set forth in the above identified parent patent application.

Two such forms of heat have been utilized for thermal forming of polymeric sheet materials and include (1) radiant heat, and (2) contact heat. Radiant heaters have been used for the most part on fixed speed, dedicated thermoforming machines. Contact heaters have had certain advantages over radiant heaters, such as being less complex in structure, and accordingly less costly to purchase and maintain. Such contact heaters have been used in a number of fixed or variable speed thermoforming machines, such as non-dedicated, form and seal machines and other machines.

In addition to the above advantages of reduced expense in purchase and maintenance, contact heaters have been less expensive to operate. In particular, contact heaters convert energy more efficiently than do radiant heaters. In addition, contact heaters have the further advantage of requiring less skilled personnel to achieve operation in a satisfactory fashion. However, the use of contact heaters into thermoforming of polymeric sheet materials has been relatively limited, and in particular has been limited to the low temperature heating of films. Once a film material has been subjected to the desirably higher temperatures which are more suitable for thermoforming, and especially the thermoforming of more precise shapes necessary for more sophisticated packaging, the softened polymeric sheet becomes tacky and tends to adhere to the surface of the contact heater. This phenomenon occurs because, as the temperature increases, the coefficient of friction of the surface of the thermoplastic sheet which is being transported past and in contact with the contact heater also increases. Thus, such increase in the coefficient of friction, and especially above the glass transition temperature of the polymeric film material has confined the use of such contact heaters to relatively low-temperature thermoforming, or cold phase thermoforming methods.

In the prior art, proposals have been made for various types of metallic packaging materials. However, with such metallic materials it has been necessary to utilize metallic coating on both sides of a film, in part because of the cosmetic necessity to cover completely both surfaces of laminated polymeric materials, which have had a "milky" or "cloudy" appearance. This cloudy appearing of film laminates has been caused by the necessity for utilizing different types of materials forming the different layers of thermoplastic materials, in order to accomplish various packaging functions, such as resistance to gaseous diffusion, thermoformability, durability, etc. Attempts to solve these problems have been somewhat less than successful.

In view of the difficulties and deficiencies of prior art methods of thermoforming polymeric film materials, it is a material object of the improved metallized package components and methods for producing the same of the present invention to alleviate such difficulties and deficiencies experienced with such prior art methods.

SUMMARY OF THE INVENTION

The problem experienced in the prior art of increases in the coefficient of friction of a polymeric film material when it is heated above its glass transition temperature (which is the temperature most suitable for thermoforming delicate shapes required for sophisticated packaging) has been materially alleviated by means of the improved metallized package component and methods of forming the same in the present invention.

In particular, the improved metallized package component of the present invention includes a thermoplastic, polymeric film laminate being formed from at least two, and possibly several, thermoplastic film layers. The thermoplastic film layers are selected to have substantially equivalent indices of refraction to minimize diffusion of light at the interfaces thereof to maintain substantial clarity and transparency of the film laminate. A metallic layer is disposed on at least one exterior surface of the film laminate, and accordingly is visible through the film from the opposite side thereof to provide a metallic appearance to both sides of the film laminate.

The improved method of forming a metallized package component of the present invention comprises supplying a thermoplastic film laminate in roll form and continuously disposing the metallized surface thereof into contact with a contact heater. Such contacted film was raised to a selected temperature above the glass transition temperature of the thermoplastic laminate to render the film laminate in the semi-fluid and thus very thermoformable state, which does increase the coefficient of friction of the polymeric film material, but which is simultaneously lubricated by the metallized surface thereof. Thereafter, the metallized film material in such semi-fluid and very thermoformable state may be thermoformed into the delicate shapes needed for sophisticated packaging, such as locking mechanisms, hinge mechanisms, etc.

The above features of the improved metallized packaging component and methods of forming the same will be better understood by those skilled in the art upon review of the following brief description of the drawing, detailed description of preferred embodiments, pending claims, and accompanying drawing.

BRIEF DESCRIPTION OF THE DRAWING

The basic features of the improved metallized packaging component and methods of producing the same are depicted in the accompanying drawing, and in which.

DETAILED DESCRIPTION OF PREFERRED EMBODIMENTS

Figure 1:
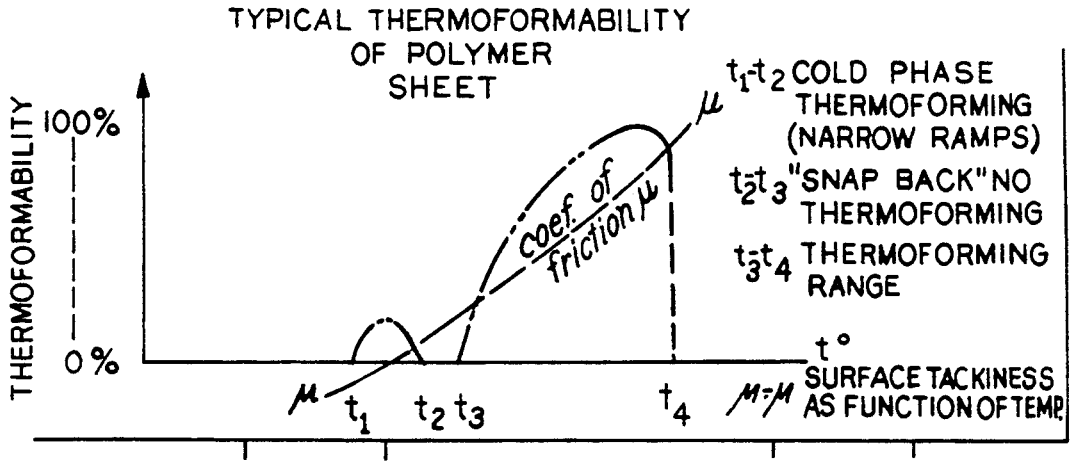
FIG. 1 is a graphical representation of the thermoformability of a polymeric film material showing on one axis the percentage of thermoformability and showing on the other axis the temperature, whereby the thermoformability in general terms increases with temperature, but which is affected by significant phenomena explained in greater detail hereinbelow, and the coefficient of friction is also shown to increase with the temperature.

Wherever it has been necessary to thermoform thermoplastic polymeric film materials at high temperatures, and the use of radiant heaters is also impractical for technical and/or economic reasons, the thermoforming of a sheet of thermoplastic film materials may be unexpectedly achieved with superior results utilizing a simple contact heater through use of the present invention. As indicated, supra, the increasing coefficient friction of the surface of the polymeric film material is a severe difficulty which must be overcome in order to utilize such preferred contact heaters. The present invention materially avoids such difficulty by providing and utilizing a metallized, and accordingly lubricated, surface of the polymeric film material.

Such thermoplastic, metallized polymeric film material preferably may contain an outer layer of polymer which thermoforms at relatively low temperatures, but which maintains a very high strength at increased temperatures without melting. The outer surface of such outer layer of film is coated with a very thin layer of essentially pure aluminum in preferred embodiments. Such layer of aluminum prevents the surface of the heated film from becoming excessively tacky or sticky, which is caused by the increase in friction accompanying the increase in temperature necessary to raise such film to the desired thermoforming temperatures.

Such metallized polymeric film material is formed in general by coating a thin layer of metal (preferably aluminum, although other materials such as copper may be utilized) to such thermoplastic film material. In addition, the metallization of such film material provides the further advantages of improved gaseous barrier capability, as well as enhancing the appearance of the plastic film material to provide a metallized appearance to both sides of the film.

In the production process for producing such a metallized film, a metallizer machine is preferably utilized. Such metallizer machines are similar to a conventional coater. In such metallizer machines, a roll of film is secured to a stand, unwound, threaded through rollers, and then is passed over a spray head for applying vaporized metal to the exposed surface. The metal condenses upon contact with the film, which is then wound upon a spool. The entire metallization process must take place in a vacuum chamber, as aluminum and most other metallic substances will not vaporize properly and at suitable temperatures, except in a vacuum. A variant of the above procedure may involve extruding an additional layer of film onto the metallized film to improve sealability and the moisture barrier characteristics of the laminated material.

Further advantages of the metallized film materials so produced are that the shelf life of a comestible product contained within a package formed of such metallized film will be extended in order to protect product freshness. When aluminum is utilized for such coating, a layer 30 nm is sufficient to provide the above improvement in moisture and/or gaseous barrier properties. Such increases in performance of packaging materials are difficult of achievement except by the present means of metallization. A further advantage of the metallization hereof is that such metallized layers also restrict the entry of light into the package which may cause oxidative rancidity of fatty and fried foods. Suppliers of such metallized film include:

Gomar Manufacturing Co., Inc.
1501 W. Blancke St.
Linden, N.J. 07036
(205) 862-0820
Scharr Industries, Inc.
40 E. Newberry Rd.
Bloomfield, Conn. 06002
(203) 243-0343
Newtown Industrial Commons
207 Penns Trail
Newtown, Pa. 18940
(215) 968-0442

In view of the above metallized polymeric film material, it is possible to heat the entire film to relatively high-forming temperatures utilizing the efficiency of a contact heater, and to obtain ultimately the same high forming resolutions which may be obtained through use of the more costly and less efficient radiant heater mechanisms.

Additional layers of the metallized polymeric film material hereof preferably include in preferred embodiments a thermoformable center or core, which may be made of polyvinyl fluoride, high impact styrenes or thermoforming polyesters. These additional layers for the metallized thermoplastic polymeric film material of the present invention may further include low diffusion layers, such as polyvinyledene chloride or ethyl vinyl alcohol. In addition, the sheet of metallized thermoplastic polymeric film material may include a thermofusable sealant material to seal various layers together, and may be applied by means known to those skilled in the art.

In addition to the above advantages, the metallic layer disposed on the surface of the metallized thermoplastic polymeric film material may serve in preferred embodiments as a thermal conductor during heating, and may simultaneously serve to prevent the surface of the film from becoming tacky at the proper thermoforming temperatures.

A further unexpected property of the improved metallized package component and forming methods of the present invention is that such metallized thermoplastic polymeric film material may be formed "in line", and using versatile form, fill, and seal machines dedicated thereto and at fixed speeds.

Accordingly, by utilizing the present invention, it is possible to thermoform such metallized polymeric film materials utilizing standard form, fill and seal machines with the quality of preformed plastic containers, which has previously been achievable only on a separate dedicated machine, or by other means which were not "on line". Such polymeric containers formed by such "on line" means are more economical, and accordingly available to replace more expensive preformed, and "off line" formed and assembled containers.

By way of contrast, whereas the conventional non-metallized PVC sheet of prior art methods and containers can be heated to a maximum temperature of 350° F. without adhering to the surface of the contact heater, the metallized surface of the metallized polymeric thermoformable polymeric film material of the present invention may be heated to temperatures of at least 400° F. without detrimental effects.

In addition to the above, polyamide may be utilized to act as a "safety net" for polyvinyl chloride or PET layers. Such a "safety net" layer serves to prevent the formation of wrinkles in the formulated package component material.

Referring to the drawing and to FIG. 1 in particular, which shows a graphic representation of the percentage of formability versus the temperature of formation, the curve $T_1$–$T_2$ represents the cold phase temperature wherein some thermoforming is possible, although the range is relatively narrow, and the sheet is only partially tacky. In this range, contact heaters have been previously employed in the prior art effectively for thermoforming. However, a sheet formed at this cold phase thermoforming range may often contain stresses and dimensional stability thus in general tends to be poor. Also, detailed thermoforming is not achievable at such temperature.

Range $T_2$–$T_3$ is the "snap back" range, wherein the film sheet becomes reoriented and will not thermoform. Curve $T_3$–$T_4$ represents the temperature range for thermoforming wherein minimal residual stresses and dimensional instabilities are present, along with good detail reproduction in the formed film. In the thermoforming stage, the surface becomes very tacky. In the past, the polymeric film materials utilized have been heated to these temperatures of thermoformability exclusively with radiant heaters.

Also shown in FIG. 1 is curve $u_1$–$u_2$, which is a schematic representation of the co-efficient of friction u which increases in the manner shown with the temperature. In the range of thermoformability $T_3$–$T_4$ such coefficient of friction u becomes sufficiently great to prevent the utilization of contact heaters, in the absence of utilization of the metallized thermoplastic polymeric film materials and methods of the present invention.

Figure 2:
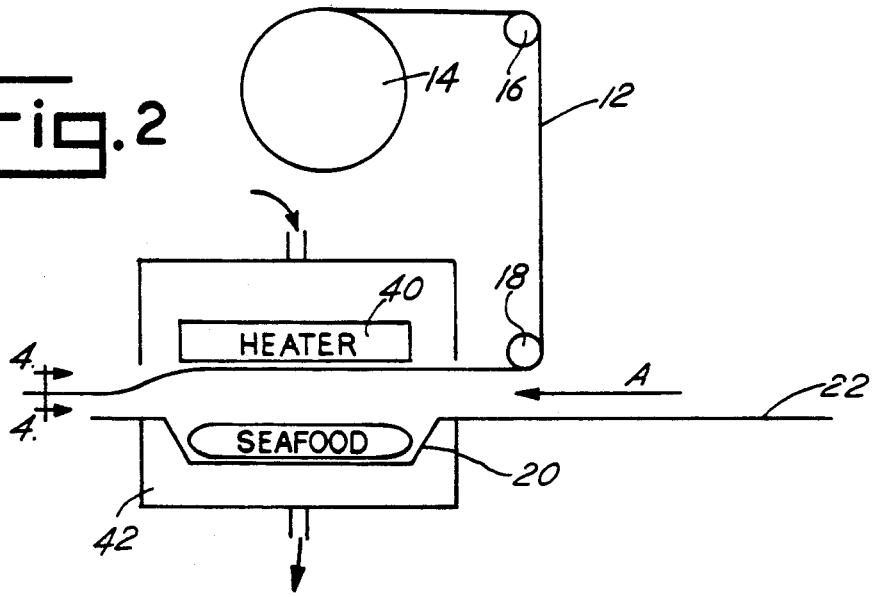
FIG. 2 is a side view of apparatus for utilizing a contact heater in the thermoforming of package components utilizing metallized polymeric film material.
Figure 4:
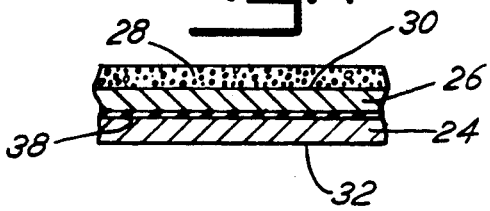
FIG. 4 is a greatly enlarged fragmented cross-sectional view taken along lines 4—4 of FIG. 2 and showing the metallized polymeric film material hereof having in such example two different polymeric film layers and a metallized layer on the top surface thereof.

To set forth the present invention in somewhat greater detail, and as depicted in FIG. 2 in particular, the improved metallized package component aspect of the present invention comprises a thermoplastic polymeric laminate film 12 preferably stored in a roll 14 and guided by rollers 16, 18. Such film 12 has an appropriate size and shape for covering a container 20, which has been formed from tray stock 22. Such film 12 may hvae at least two thermoplastic film layers 24, 26 as shown in FIG. 4, although additional layers having additional functions known to those skilled in the art are contemplated as being a part of the present invention. The thermoplastic film layers 24, 26 adjoin together to form the film laminate element of the present invention. The thermoplastic film layers 24, 26 are selected to have substantially equivalent indices of refraction in order to minimize diffusion of light at the interface thereof, and in order to maintain substantial clarity and transparency of the film laminate thereby.

Also as shown in FIG. 4, a metallic layer 28 is disposed on a top surface 30 of the film laminate 12. Accordingly, the metallic layer 28 is visible and retains its metallic appearance when viewed from the opposite surface 32 of the film laminate.

Figure 3:
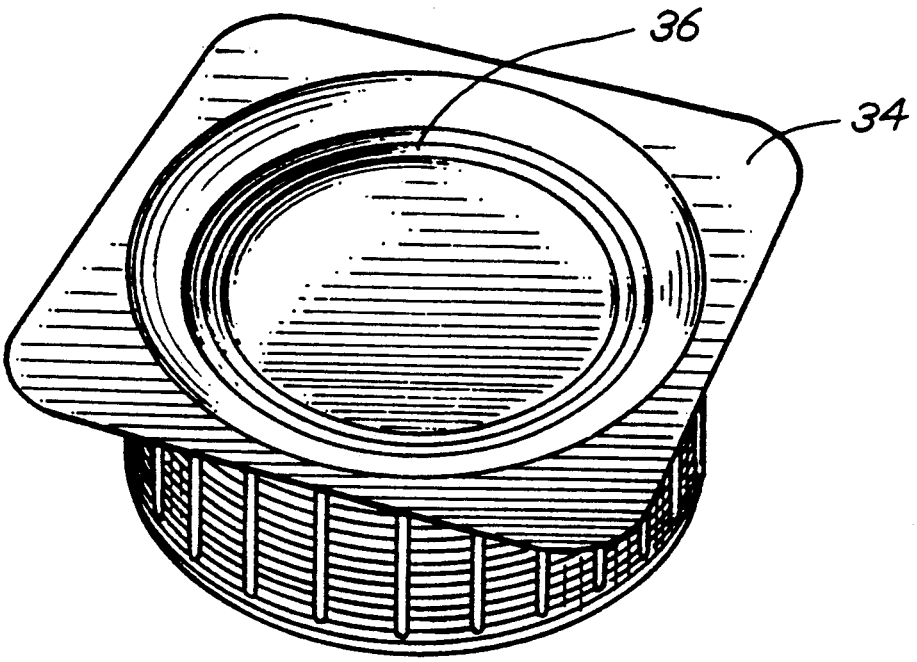
FIG. 3 is a perspective view of a metallized lid shown engaged upon a matching container.

As shown in FIG. 3, in preferred embodiments, such metallized package component may comprise a lid 34 for use in conjunction with a container. In such preferred embodiments, such lid 34 may include a ring engagement means 36 for substantially sealingly engaging a mainly disposed means on such container.

The film layers 24, 26 of the thermoplastic polymeric film material 12 in preferred embodiments have substantial oxygen barrier characteristics. Also, such characteristics as peelability and substantial strength are preferably present in such film layers.

In other preferred embodiments, the film layers 24, 26 may contain a colorant to provide a metallic colored appearance to the opposite surface of the film laminate, such as copper colored.

As set forth in FIG. 4, at least one adhesive 38 may be included in some embodiments for bonding together the thermoplastic film layers. Such adhesive in these preferred embodiments may also have an index of refraction which is substantially equivalent to the indices of refraction of the thermoplastic film layers 24, 26. The result is to minimize diffusion of light at the interface between the adhesive and any such thermoplastic layers 24, 26 in combination therewith in order to maintain the substantial clarity and transparency of the film laminate.

In preferred embodiments, as indicated supra, the metallic element 28 may preferably comprise aluminum, although copper and other metallic elements are within the scope of the present invention. The thickness of such metallic layer may be approximately 30 nm.

In the method aspect of the improved method of forming a metallized package component of the present invention, and as shown in FIG. 2 a thermoplastic polymeric film laminate 12 is provided in roll form 14, and which has a metallized surface 28 thereof. The metallized surface 28 of the thermoplastic film laminate 12 is continuously disposed into contact with the contact heater 40 and continuously heated thereby to a selected temperature greater than the glass transition temperature of the thermoplastic film laminate. As indicated, such glass transition temperatures for most materials exceed 315° F., although the specific temperature to be utilized depends upon the meltability characteristics of the thermoplastic laminate film material 12 being utilized. The result of such heating is to render the film laminate 12 into a semi-fluid and thermoformable state which, on the one hand, increases the coefficient of friction of the polymeric film laminate material, but which on the other hand is lubricated across the surface of the contact heater 40 by means of the metallized surface 28. Finally, the package components are thermoformed from the semi-fluid and thermoformable film laminate material, such as by assistance of vacuum chamber 42, for example.

In the above preferred methods, the glass transition temperature of the film laminate is in general a temperature which is above the initial melting temperature and further above a "snap back" temperature of substantially no thermoformability. Such selected heated temperature of the film laminate is sufficient to minimize residual stress in the film laminate. Also, the first layer of the film laminate comprises layers selected from the group consisting in preferred embodiments of polyvinyl chloride, high impact styrenes, and thermoforming polyesters. The film laminate preferably utilizable in such methods further preferably includes a second layer selected from the group consisting of polyvinyledene chloride and ethyl vinyl alcohol. Such film laminate for use in such preferred in methods may further also include a layer of thermofusable sealant disposed between the polymeric layers of the film material. Other films may likewise be usable.

The basic and novel characteristics of the improved methods and apparatus of the present invention will be readily understood from the foregoing disclosure by those skilled in the art. It will become readily apparent that various changes and modifications may be made in the form, construction and arrangement of the improved apparatus of the present invention, and in the steps of the inventive methods hereof, which various respective inventions are as set forth hereinabove without departing from the spirit and scope of such inventions. Accordingly, the preferred and alternative embodiments of the present invention set forth hereinabove are not intended to limit such spirit and scope in any way.

What is claimed is:

1. An improved metallized package component comprising:

a thermoformable thermoplastic polymeric film laminate having appropriate size and shape for covering a container, said film laminate having at least two thermoplastic film layers joined together to form said film laminate;

said thermoplastic film layers having substantially equivalent indices of refraction to minimize diffusion of light at the interface thereof to maintain substantial clarity and transparency of said film laminate; and a metallic layer disposed on one surface of said film laminate, said metallic layer being visible and retaining its metallic appearance when viewed from the opposite surface of said film laminate.

2. The improved metallized package component of claim 1 wherein said component comprises a lid for use in conjunction with a container.

3. The improved metallized package component of claim 2 wherein said lid includes rim engagement means for substantially sealing engagement with matingly disposed means on said container.

4. The improved metallized package component of claim 1 wherein at least one of said film layers has substantial oxygen barrier characteristics.

5. The improved metallized package component of claim 1 wherein at least one of said film layers contains a colorant to provide a metallic colored appearance to said opposite surface of said film laminate.

6. The improved metallized package component of claim 1 further comprising at least one adhesive means for bonding together said thermoplastic film layers, said adhesive means having an index of refraction which is substantially equivalent to said indices of refraction of said thermoplastic film layers to minimize diffusion of light at the interface thereof to maintain substantial clarity and transparency of said film laminate.

7. The improved metallized package component of claim 1 wherein said metallic layer comprises aluminum.

8. The improved metallized package component of claim 1 wherein said metallic layer comprises copper.

9. The improved metallized package component of claim 1 wherein said metallic layer is approximately 30 nm in thickness.

* * * * *